US009305495B2

(12) United States Patent
Nakanishi

(10) Patent No.: US 9,305,495 B2
(45) Date of Patent: Apr. 5, 2016

(54) DISPLAY DEVICE AND DISPLAY METHOD FOR ESTIMATING BACKLIGHT LUMINANCE DISTRIBUTION

(75) Inventor: Atsushi Nakanishi, Nara (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 185 days.

(21) Appl. No.: 13/985,615

(22) PCT Filed: Feb. 16, 2012

(86) PCT No.: PCT/JP2012/001008

§ 371 (c)(1),
(2), (4) Date: Aug. 15, 2013

(87) PCT Pub. No.: WO2012/114682

PCT Pub. Date: Aug. 30, 2012

(65) Prior Publication Data

US 2013/0314459 A1 Nov. 28, 2013

(30) Foreign Application Priority Data

Feb. 23, 2011 (JP) ..... 2011-037042

(51) Int. Cl.
*G09G 3/34* (2006.01)
*G09G 3/36* (2006.01)

(52) U.S. Cl.
CPC ..... *G09G 3/3406* (2013.01); *G09G 3/342* (2013.01); *G09G 3/3426* (2013.01); *G09G 3/3611* (2013.01); *G09G 2320/0646* (2013.01); *G09G 2360/16* (2013.01)

(58) Field of Classification Search
CPC ... G09G 3/3406; G09G 3/342; G09G 3/3426; G09G 3/3611; G09G 2360/16; G09G 2320/0646
See application file for complete search history.

(56) References Cited

U.S. PATENT DOCUMENTS

2006/0125771 A1* 6/2006 Inuzuka ..... G09G 3/2096 345/102
2006/0214904 A1* 9/2006 Kimura et al. ..... 345/102
(Continued)

FOREIGN PATENT DOCUMENTS

JP 2010-79023 4/2010
JP 2011-13458 1/2011
(Continued)

OTHER PUBLICATIONS

International Search Report (ISR) issued Mar. 13, 2012 in International (PCT) Application No. PCT/JP2012/001008.

*Primary Examiner* — Dwayne Bost
*Assistant Examiner* — Darlene M Ritchie
(74) *Attorney, Agent, or Firm* — Wenderoth, Lind & Ponack, L.L.P.

(57) ABSTRACT

A display device includes: a display panel divided into divided regions including mutually adjacent first and second divided regions; a backlight portion having light source portions emitting light with a predetermined luminance distribution; a determination portion determining emission luminance for each divided region; a backlight driver driving the light source portions; a storage storing a division number; a setting portion dividing the divided regions to generate sub-regions, and setting the emission luminance of the sub-regions to that of the divided region; a linear interpolation portion performing linear interpolation using the emission luminance of the first and second sub-regions, to calculate an estimated value of the emission luminance distribution of the backlight portion in a region from the first to second sub-region; a signal correction portion correcting an image signal on the basis of the estimated value; and a panel driver driving the pixels of the display panel.

6 Claims, 9 Drawing Sheets

(56) References Cited

U.S. PATENT DOCUMENTS

2006/0279522 A1* 12/2006 Kurihara ..... G09G 3/3413 345/102
2008/0111784 A1* 5/2008 Tanaka et al. ..... 345/102
2008/0284719 A1* 11/2008 Yoshida ..... 345/102
2008/0297464 A1* 12/2008 Ito ..... G09G 3/3426 345/102
2009/0140975 A1* 6/2009 Nonaka et al. ..... 345/102
2009/0267890 A1* 10/2009 Park ..... G09G 3/3426 345/102
2010/0039440 A1* 2/2010 Tanaka et al. ..... 345/589
2010/0060555 A1* 3/2010 Lee ..... G09G 3/3426 345/82
2010/0225574 A1* 9/2010 Fujiwara et al. ..... 345/102
2011/0037784 A1* 2/2011 Shiomi ..... 345/690
2011/0043547 A1* 2/2011 Nonaka et al. ..... 345/690
2011/0050760 A1 3/2011 Ito et al.
2011/0141077 A1* 6/2011 Cho et al. ..... 345/207
2011/0234478 A1* 9/2011 Asano ..... G09G 3/3426 345/87
2011/0234566 A1* 9/2011 Asano ..... G09G 3/3426 345/211
2012/0105509 A1* 5/2012 Ito et al. ..... 345/690

FOREIGN PATENT DOCUMENTS

WO 2010/131359 11/2010
WO 2011/001673 1/2011
WO 2011/058713 5/2011
WO 2011/080875 7/2011

* cited by examiner

DISPLAY DEVICE AND DISPLAY METHOD FOR ESTIMATING BACKLIGHT LUMINANCE DISTRIBUTION

TECHNICAL FIELD

The present invention relates to a display device and a display method using a backlight.

BACKGROUND ART

A liquid crystal display device which uses liquid crystals as a light modulation element includes a backlight portion which illuminates a liquid crystal panel from a rear surface, and achieves display of a desired image by controlling transmissivity of light emitted from the backlight portion, by liquid crystals. In recent years, technology has become known which uses light sources, such as light emitting diodes, as backlight portions, and controls the light emission luminance of respective light sources in accordance with the image signals of divided regions of the liquid crystal panel which are illuminated by the respective light sources.

In the case where the light emission luminance of the light sources are controlled, in order to maintain the brightness of the image which is displayed on the liquid crystal panel at a level corresponding to the input image signal, it is necessary to correct the transmissivity of the liquid crystals in accordance with the luminance of the backlight portion which is incident on the liquid crystal panel. Therefore, in order to accurately determine the luminance of the backlight portion which is incident on the liquid crystal panel, in the technology described in Patent Document 1, for example, additional luminance calculation points are provided between mutually adjacent divided regions, in addition to basic luminance calculation points of respective divided regions which are provided at arrangement positions of light sources of a backlight portion. The number of added luminance calculation points is decided by the difference in the emission luminance between adjacent divided regions. On the other hand, the emission luminance distribution of the backlight portion is stored in a memory as data in advance. The luminance of the added luminance calculation points is obtained by superimposition of the emission luminance distribution which is stored in the memory and the emission luminance which is determined for each divided region.

However, in the technology described in Patent Document 1, a large memory capacity is required in order to store the data of the emission luminance distribution of the backlight portion in the memory. Furthermore, since a superimposition calculation is carried out in order to determine the luminance of the added luminance calculation points, the amount of calculation involved becomes extremely large. Therefore, the size of the circuitry and the costs increase. Consequently, there is a requirement to enable the display of images of high quality by accurately estimating the emission luminance distribution of the backlight portion without increasing the size of the circuitry and the costs.

Patent Document 1: Japanese Patent Application Publication No. 2010-079023

SUMMARY OF INVENTION

The present invention was devised in order to resolve the problems described above, an object thereof being to provide a display device and a display method whereby images of high quality can be displayed by accurately estimating emission luminance distribution of a backlight portion, by a simple composition and at low cost.

A display device according to an aspect of the present invention includes: a display panel which has pixels, is virtually divided into divided regions including a first divided region and a second divided region that are mutually adjacent in a predetermined adjacent direction, and displays an image corresponding to an input image signal; a backlight portion which has light source portions that are respectively arranged corresponding to the divided regions and emit light with a predetermined luminance distribution to illuminate the display panel from a rear surface thereof; a determination portion which determines emission luminance for each of the divided regions, in response to the image signal; a backlight driver which drives the light source portions so as to emit light at the emission luminance determined for each of the divided regions by the determination portion; a storage which stores a division number that is set in advance on the basis of the luminance distribution of the light source portions; a setting portion which divides the divided regions to respectively generate sub-regions of a number equal to the division number, and sets the emission luminance of the generated sub-regions to a value equal to the emission luminance of the divided region which contains the sub-regions; a linear interpolation portion which performs linear interpolation in pixel units using emission luminance of a first sub-region and emission luminance of a second sub-region, to calculate, for each of the pixels, an estimated value of the emission luminance distribution of the backlight portion in a region from the first sub-region to the second sub-region, the first sub-region being a sub-region, of the first divided region, which is adjacent to a boundary between the first divided region and the second divided region, the second sub-region being a sub-region, of the second divided region, which is adjacent to the first sub-region; a signal correction portion which corrects the image signal, for each of the pixels, on the basis of the estimated value calculated by the linear interpolation portion, to generate drive signals for the pixels of the display panel; and a panel driver which drives the pixels of the display panel in response to the drive signals generated by the signal correction portion.

Moreover, a display method according to an aspect of the present invention is a display method used in a display device having: a display panel which has pixels, is virtually divided into divided regions including a first divided region and a second divided region that are mutually adjacent in a predetermined adjacent direction, and displays an image corresponding to an input image signal; and a backlight portion which has light source portions that are respectively arranged corresponding to the divided regions and emit light with a predetermined luminance distribution to illuminate the display panel from a rear surface thereof, the display method comprising: a determining step of determining emission luminance for each of the divided regions, in response to the image signal; a backlight driving step of driving the light source portions so as to emit light at the emission luminance determined for each of the divided regions in the determining step; a setting step of respectively dividing the divided regions to generate sub-regions of a number equal to a division number predetermined on the basis of the luminance distribution of the light source portions, and setting the emission luminance of the generated sub-regions to a value equal to the emission luminance of the divided region which contains the sub-regions; a linear interpolating step of performing linear interpolation in pixel units using emission luminance of a first sub-region and emission luminance of a second sub-region to calculate, for each of the pixels, an estimated value of the emission luminance distribution of the backlight portion in a region from the first sub-region to the second sub-region, the first sub-region being a sub-region, of the first divided region, which is adjacent to a boundary between the first divided region and the second divided region, the second sub-region being a sub-region, of the second divided region, which is adjacent to the first sub-region; a signal correcting step of correcting the image signal, for each of the pixels, on the basis of the estimated value calculated in the linear interpolating step to generate drive signals for the pixels of the display panel; and a panel driving step of driving the pixels of the display panel in response to the drive signals generated in the signal correcting step.

BRIEF DESCRIPTION OF DRAWINGS

FIGS. 2A to 2C are diagrams showing an example of sub-regions generated by dividing the divided regions, in which FIG. 2A shows one example of the luminance distribution of the light source, FIG. 2B shows the emission luminance distribution at a boundary of divided regions when using the light source shown in FIG. 2A, and FIG. 2C shows an estimation result of the emission luminance distribution.

FIGS. 3A to 3C are diagrams showing an example of sub-regions generated by dividing the divided regions, in which FIG. 3A shows another example of the luminance distribution of the light source, FIG. 3B shows the emission luminance distribution at a boundary of divided regions when using the light source shown in FIG. 3A, and FIG. 3C shows an estimation result of the emission luminance distribution.

DETAILED DESCRIPTION OF INVENTION

First Embodiment

Figure 1:
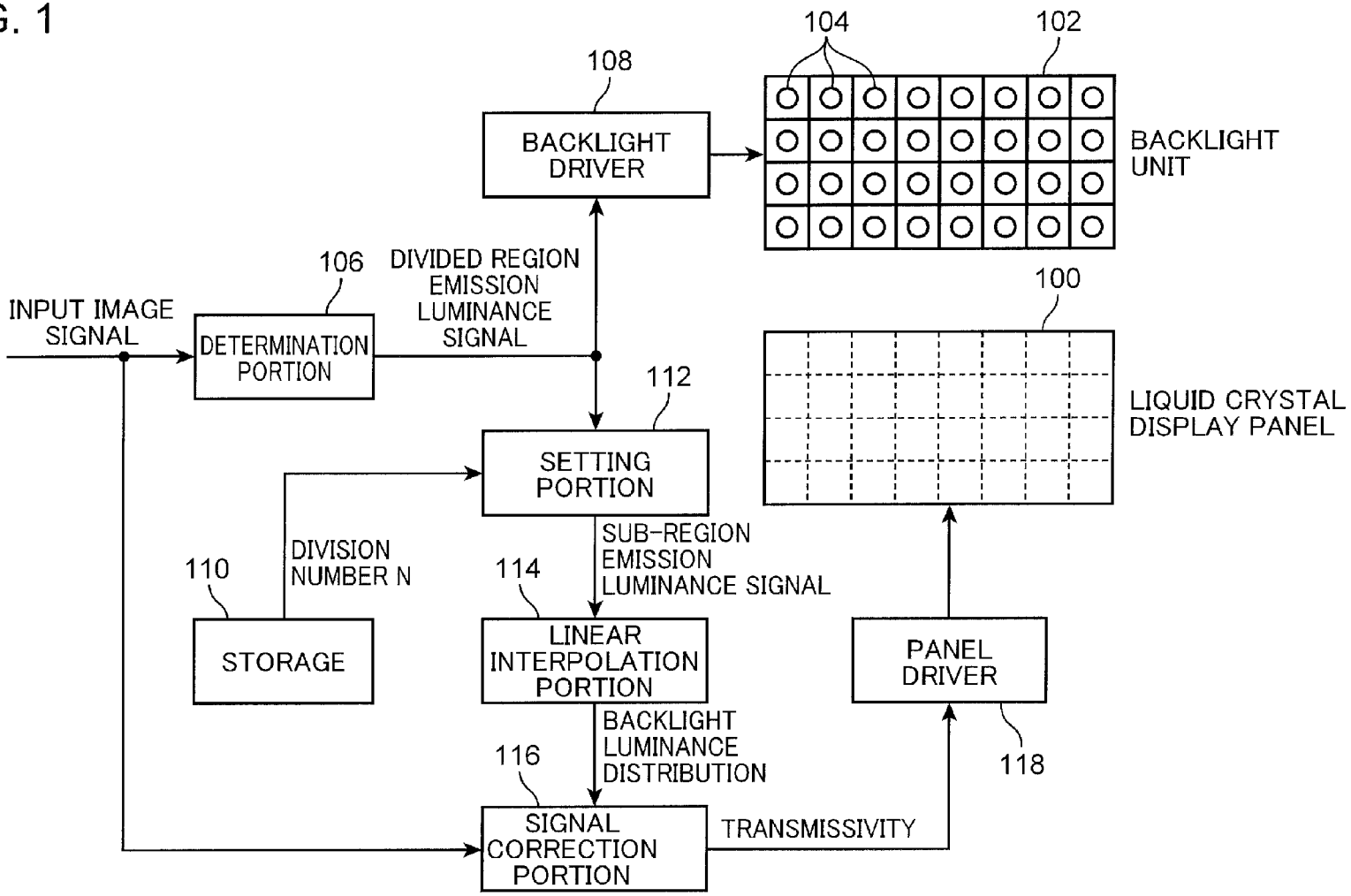
FIG. 1 is a block diagram showing a composition of a liquid crystal display device according to a first embodiment of the present invention.

A liquid crystal display device according to a first embodiment of the present invention will now be described. FIG. 1 is a block diagram showing a composition of a liquid crystal display device according to a first embodiment of the present invention. The liquid crystal display device shown in FIG. 1 includes a liquid crystal display panel 100, a backlight unit 102, a determination portion 106, a backlight driver 108, a storage 110, a setting portion 112, a linear interpolation portion 114, a signal correction portion 116 and a panel driver 118.

Although not shown in the drawings, the liquid crystal display panel 100 includes gate wires extending in a horizontal direction, source wires extending in a vertical direction, switching elements and pixels, the pixels being arranged in a matrix configuration at the points of intersection of the source wires and the gate wires, and one scanning line being constituted by one line of pixels in the horizontal direction.

Pixel signals are supplied to the source wires from the panel driver 118, and gate pulses which form a scanning signal are supplied to the gate wires from the panel driver 118, so as to apply signal voltages to the liquid crystal layers corresponding to each pixel, thereby controlling the transmissivity. As indicated by the dotted line in FIG. 1, the display surface of the liquid crystal display panel 100 is divided virtually into divided regions. The divided regions are provided in a matrix configuration and each have a square shape.

The liquid crystal display panel 100 may employ an IPS (In Plane Switching) method or VA (Vertical Alignment) method, or an UV2A (Ultra Violet induced multi-domain Vertical Alignment) method which irradiates ultraviolet light onto liquid crystal molecules, or another method.

The backlight unit 102 has light source portions 104 which emit light in a prescribed luminance distribution, thereby illuminating the liquid crystal display panel 100 from the rear surface and causing an image to be displayed on the liquid crystal display panel 100. The backlight unit 102 is divided into divided regions which correspond respectively to the divided regions of the liquid crystal display panel 100. The light source portions 104 are arranged respectively at each divided region and are each composed so as to emit light towards the corresponding divided region of the liquid crystal display panel 100.

In this embodiment, the light source portion 104 is constituted by a white light-emitting diode (called "LED" below) for example. The light source portions 104 may be equipped with a red LED, a green LED and a blue LED, and be composed so as to obtain white light from these three LEDs. The light source portions 104 are driven by the backlight driver 108. A composition is adopted which enables the emission luminance of each light source portion 104 to be controlled independently, in each divided region. In other words, when the light source portion 104 is constituted by white LEDs, for example, the white LEDs are driven in an integrated fashion so as to emit light at the same emission luminance.

The determination portion 106 analyzes the input image signal and determines the emission luminance of each light source portion 104 on the basis of the results of this analysis. More specifically, the determination portion 106 determines the emission luminance for each divided region. The determination portion 106 outputs each determined emission luminance as a divided region emission luminance signal to the backlight driver 108 and the setting portion 112.

In this embodiment, the determination portion 106, for example, judges the maximum value of the luminance of each pixel in the divided region, and calculates the emission luminance of the light source portion 104 corresponding to that divided region from this maximum value, on the basis of a predetermined calculation formula. Alternatively, the determination portion 106 may include a table which associates a maximum value of the luminance of each pixel in a divided region with emission luminance of the light source portion 104, and may specify emission luminance corresponding to the maximum value of the luminance of the pixels in the divided region, as the emission luminance of the light source portion 104.

As a further alternative, the determination portion 106 may evaluate the average value of the luminance of the pixels in the divided region, and determine the emission luminance of the light source portion 104 of that divided region, on the basis of the evaluation result. As yet a further alternative, the determination portion 106 may evaluate two or more of three factors, namely, the maximum value of the luminance of the pixels in the divided region, the average value of the luminance of the pixels in the divided region, and the average value of the luminance of the pixels in the whole image surface, and then determine the emission luminance of each divided region by calculating a weighted average of these values, applying gain adjustment, or the like. In this way, the details of the analysis of the input image signal performed by the determination portion 106 are arbitrary.

The backlight driver 108 drives the light source portions 104 of the divided regions in the backlight unit 102 so as to emit light at the emission luminance determined by the determination portion 106, on the basis of divided region emission luminance signals input from the determination portion 106.

The storage 110 stores a predetermined division number N (where N is a positive integer). The setting portion 112 divides up the divided region to generate sub-regions which are equal in number to the division number N. The setting portion 112 sets the emission luminance of the sub-regions to a value equal to the emission luminance of the divided region. In this case, the setting portion 112 sets the emission luminance of a center position of the sub-region. The setting portion 112 outputs the emission luminance of the sub-region that has been set, to the linear interpolation portion 114, as a sub-region emission luminance signal. The linear interpolation portion 114 performs linear interpolation using the emission luminance of the sub-region to calculate an estimated value of the emission luminance distribution of the backlight unit 102, for each pixel. Below, the division number N stored in the storage 110, the setting portion 112 and the linear interpolation portion 114 are described further with reference to FIGS. 2A-2C and FIGS. 3A-3C.

Figure 2A:
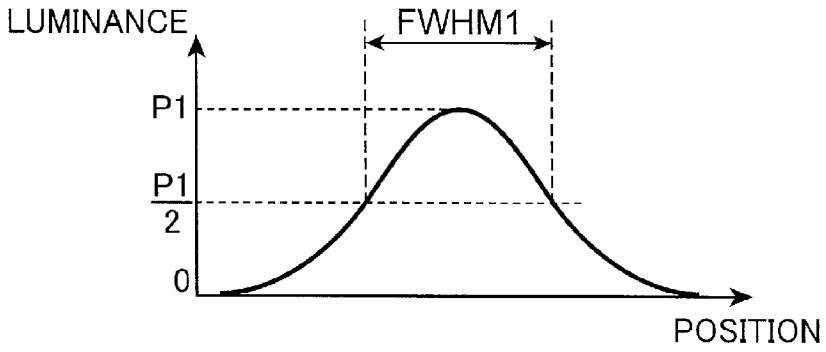
Figure 2B:
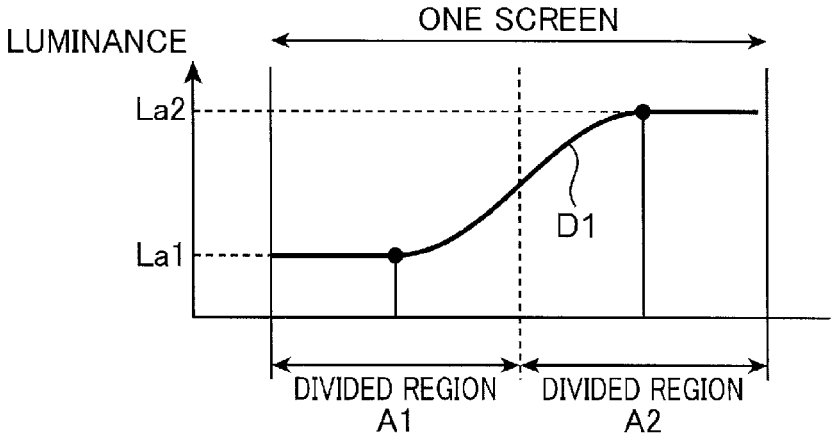
Figure 2C:
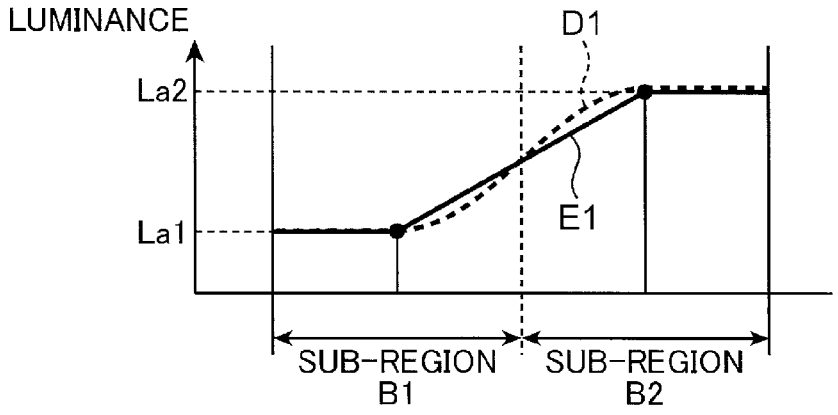
Figure 3A:
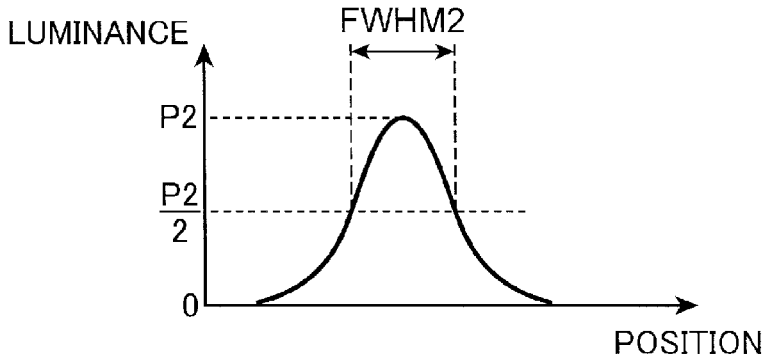
Figure 3B:
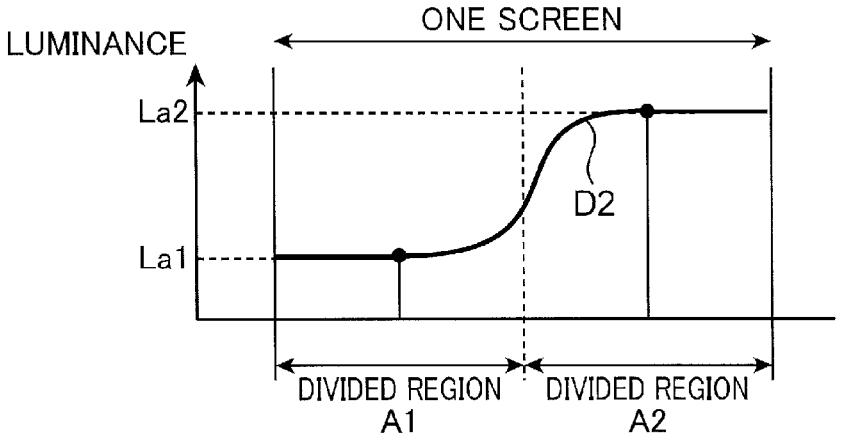
Figure 3C:
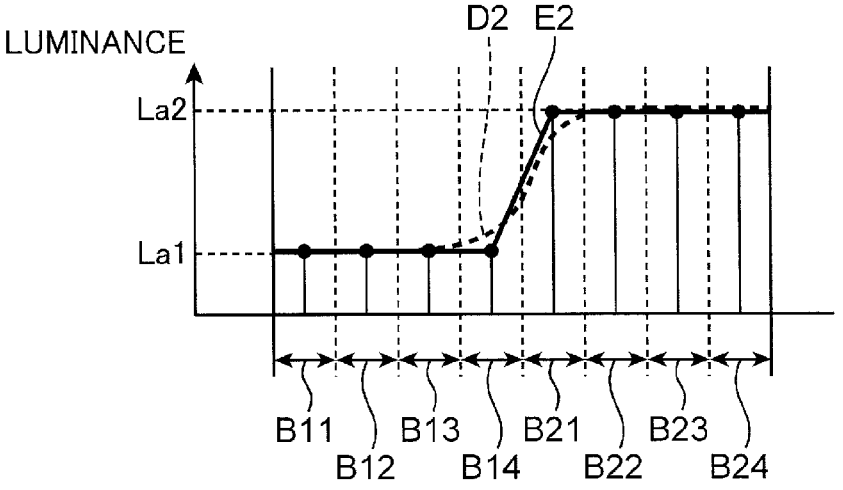

FIG. 2A-2C and FIGS. 3A-3C are diagrams which respectively show an example of a sub-region which is generated by dividing a divided region. FIG. 2A shows one example of the luminance distribution of the light source, FIG. 2B shows the emission luminance distribution at a boundary of divided regions when using the light source shown in FIG. 2A, and FIG. 2C shows an estimation result of the emission luminance distribution. FIG. 3A shows another example of the luminance distribution of the light source, FIG. 3B shows the emission luminance distribution at a boundary of divided regions when using the light source shown in FIG. 3A, and FIG. 3C shows an estimation result of the emission luminance distribution. Here, in the case of both FIG. 2B and FIG. 3B, it is supposed that the determination portion 106 determines the emission luminance La1 in respect of the divided region A1, and the emission luminance La2 in respect of the divided region A2. As shown in FIG. 2B and FIG. 3B, La1<La2.

When the full width at half maximum FWHM1 of the luminance distribution of the light source shown in FIG. 2A is compared with the full width at half maximum FWHM2 of the luminance distribution of the light source shown in FIG. 3A, then FWHM1>FWHM2. More specifically, the light source shown in FIG. 2A has a broad luminance distribution compared to the light source shown in FIG. 3A. In other words, the light source shown in FIG. 3A has a sharp luminance distribution compared to the light source shown in FIG. 2A.

When a light source having a broad luminance distribution as shown in FIG. 2A is used as the light source portion 104, as shown in FIG. 2B, there is a gradual change in the emission luminance distribution D1 at the boundary between the divided regions A1 and A2. Therefore, in the case where a light source having the luminance distribution shown in FIG. 2A is used as the light source portion 104, the division number N=N1 is stored previously in the storage 110 (in this embodiment, N1=1, for example).

Consequently, as shown in FIG. 2C, the setting portion 112 sets the divided region A1 directly as the sub-region B1, and sets the divided region A2 directly as the sub-region B2. Furthermore, the setting portion 112 sets the emission luminance of the sub-region B1 to a value equal to the emission luminance La1 of the divided region A1, and sets the emission luminance of the sub-region B2 to a value equal to the emission luminance La2 of the divided region A2. As a result of this, the linear interpolation portion 114 uses the emission luminance La1 of the sub-region B1 and the emission luminance La2 of the sub-region B2 to calculate an estimated value E1 for the emission luminance distribution of the backlight unit 102, for each pixel, by linear interpolation in pixel units, as shown in FIG. 2C.

On the other hand, when a light source having a sharp luminance distribution as shown in FIG. 3A is used as the light source portion 104, as shown in FIG. 3B, there is a sudden change in the emission luminance distribution D2 at the boundary between the divided regions A1 and A2. Therefore, in the case where a light source having a luminance distribution such as that shown in FIG. 3A is used as the light source portion 104, the division number N=N2 is stored previously in the storage 110 (in this embodiment, N2=4, for example).

Consequently, the setting portion 112 divides up the divided region A1 to generate four sub-regions B11 to B14, as shown in FIG. 3C, and divides up the divided region A2 to generate four sub-regions B21 to B24. Furthermore, the setting portion 112 sets the emission luminance of the sub-regions B11 to B14 to a value equal to the emission luminance La1 of the divided region A1, and sets the emission luminance of the sub-regions B21 to B24 to a value equal to the emission luminance La2 of the divided region A2.

The linear interpolation portion 114 performs linear interpolation using the emission luminance of the adjacent sub-regions, in pixel units, to calculate an estimated value E2 of the emission luminance distribution of the backlight unit 102. The linear interpolation portion 114 carries out linear interpolation using the emission luminance La1 of the sub-region B13 and the emission luminance La1 of the sub-region B14, in a region from the sub-region B13 to the sub-region B14, for instance, and therefore emission luminance La1 having the same value is determined as the estimated value E2 of the emission luminance distribution. Furthermore, the linear interpolation portion 114 carries out linear interpolation using the emission luminance La1 of the sub-region B14 and the emission luminance La2 of the sub-region B21, in a region from the sub-region B14 to the sub-region B21, for instance, and therefore emission luminance having a diagonal linear shape linking the emission luminance La1 and the emission luminance La2 is determined as the estimated value E2 of the emission luminance distribution.

As described above, the division number N which is set in accordance with the luminance distribution of the light sources used for the light source portions 104 is stored in the storage 110. In this embodiment, the division number N1 when the full width at half maximum of the luminance distribution of the light source is FWHM1 and the division number N2 when the full width at half maximum of the luminance distribution of the light source is FWHM2 are set in such a manner that N1<N2, when FWHM1>FWHM2. More specifically, a larger value is stored as the division number N in the storage 110, when the luminance distribution at the boundary of adjacent divided regions shows sharp characteristics, compared to when this luminance distribution shows gradual characteristics.

In order to simplify the description, FIGS. 2A-2C and FIGS. 3A-3C show an example where the divided regions A1 and A2 are divided in the horizontal direction to generate the sub-regions B1, B2, etc., and linear interpolation is carried out in the horizontal direction. In this embodiment, the setting portion 112 divides the divided regions in the horizontal direction and the vertical direction so as to generate sub-regions in a matrix configuration, and the linear interpolation portion 114 carries out linear interpolation in the horizontal direction and the vertical direction. Below, the linear interpolation performed by the linear interpolation portion 114 is described in detail with reference to FIG. 4 and FIG. 5.

Figure 4:
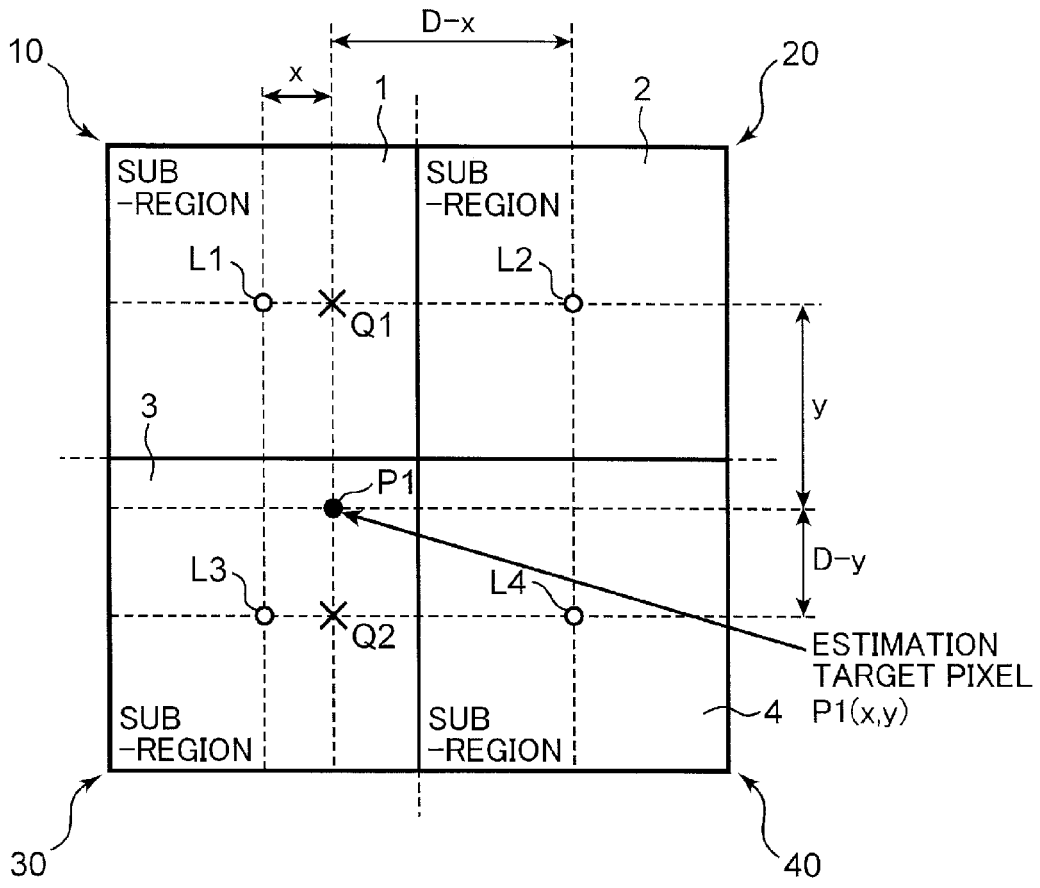
FIG. 4 is a diagram illustrating linear interpolation performed by the linear interpolation portion.
Figure 5:
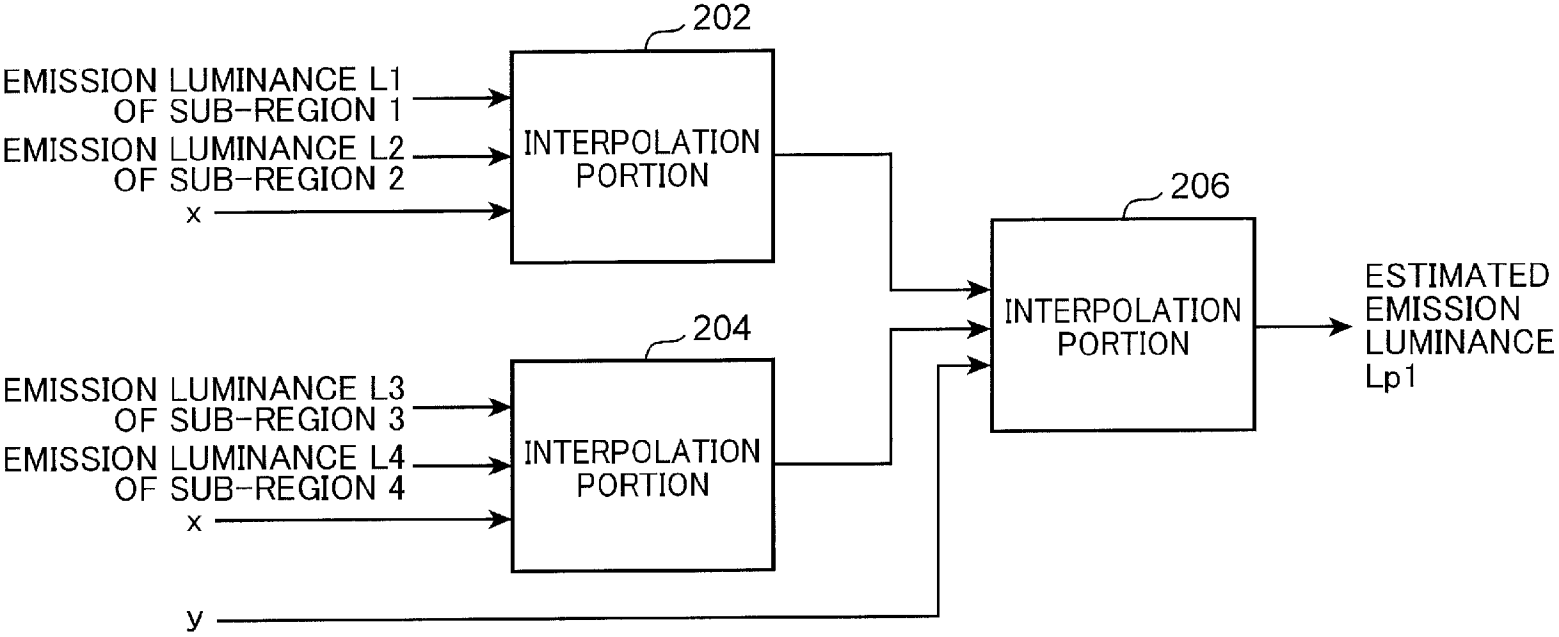
FIG. 5 is a block diagram showing a linear interpolation portion.

FIG. 4 is a diagram illustrating linear interpolation performed by the linear interpolation portion 114. FIG. 5 is a block diagram showing a composition of the linear interpolation portion 114. In FIG. 4, the sub-region 1 is one sub-region which is generated by dividing up a divided region 10 in the horizontal direction and the vertical direction. Similarly, the sub-regions 2, 3 and 4 are each one sub-region which is generated by dividing up the divided regions 20, 30 and 40 in the horizontal direction and the vertical direction. More specifically, FIG. 4 shows a boundary portion of the divided regions 10, 20, 30 and 40. The determination portion 106 respectively determines the values L1, L2, L3 and L4 as the emission luminance of the divided regions 10, 20, 30 and 40. Therefore, the setting portion 112 respectively sets the values L1, L2, L3 and L4 as the emission luminance of the sub-regions 1, 2, 3 and 4. In the example shown in FIG. 4, the sub-regions 1 to 4 are square and the distance between the centers of the sub-regions 1 to 4 in the adjacent direction is D. This distance D is calculated by the setting portion 112 in accordance with the division number N, for example, and is input from the setting portion 112 to the linear interpolation portion 114.

As shown in FIG. 5, the linear interpolation portion 114 includes interpolation portions 202, 204 and 206 which carry out linear interpolation calculations. The emission luminance L1 of the sub-region 1, the emission luminance L2 of the sub-region 2, and the horizontal-direction coordinate value x are input to the interpolation portion 202. The interpolation portion 202 performs linear interpolation using the values L1, L2, (D−x) and x, and thereby determines the emission luminance at the position Q1 which is shown in FIG. 4. Similarly, the emission luminance L3 of the sub-region 3, the emission luminance L4 of the sub-region 4, and the horizontal-direction coordinate value x are input to the interpolation portion 204. The interpolation portion 204 carries out linear interpolation using the values L3, L4, (D−x) and x, and thereby determines the emission luminance at the position Q2 which is shown in FIG. 4. Moreover, the emission luminance at the position Q1 which is the calculation result from the interpolation portion 202, the emission luminance at the position Q2 which is the calculation result from the interpolation portion 204, and the vertical-direction coordinate value y, are input to the interpolation portion 206. The interpolation portion 206 determines emission luminance for an estimation target pixel P1 $(x,y)$ by performing linear interpolation using the emission luminance at the positions Q1 and Q2, and the values of (D−y) and y. In this embodiment, interpolation is carried out in the vertical direction after carrying out interpolation in the horizontal direction, but the invention is not limited to this. It is also possible to carry out interpolation in the horizontal direction after carrying out interpolation in the vertical direction.

As described above, the linear interpolation portion 114 carries out linear interpolation in the horizontal direction and the vertical direction using the emission luminance L1 to L4 of the sub-regions 1 to 4 at the boundaries between the mutually adjacent divided regions 10 to 40 (the square region enclosed by the respective centers of the sub-regions 1 to 4 in FIG. 4), and thereby determines an estimated value of the emission luminance distribution of the backlight unit 102, for each pixel. In this embodiment, the divided regions 10, 20, 30 and 40 respectively correspond to first, second, fourth and fifth divided regions. Furthermore, the sub-regions 1, 2, 3 and 4 respectively correspond to first, second, fourth and fifth sub-regions. Furthermore, the emission luminance L1, L2, L3 and L4 respectively correspond to first, second, fourth and fifth luminance values. Furthermore, x corresponds to a first distance, (D−x) corresponds to a second distance, y corresponds to a third distance, and (D−y) corresponds to a fourth distance. Moreover, the emission luminance at position Q1 corresponds to a first interpolation value, and the emission luminance at position Q2 corresponds to a second interpolation value. Furthermore, the horizontal direction corresponds to an adjacent direction and the vertical direction corresponds to a perpendicular direction. Moreover, the estimation target pixel P1$(x,y)$ corresponds to a calculation target pixel.

Returning to FIG. 1, the signal correction portion 116 adjusts a gain of an input image signal, for example, in accordance with an estimated value of the emission luminance distribution of the backlight unit 102 which is determined respectively for each pixel by the linear interpolation portion 114, corrects the image signal so as to maintain a similar luminance to the input image signal, and calculates the transmissivity of each pixel. Below, the signal correction performed by the signal correction portion 116 will be described with reference to FIG. 6.

Figure 6:
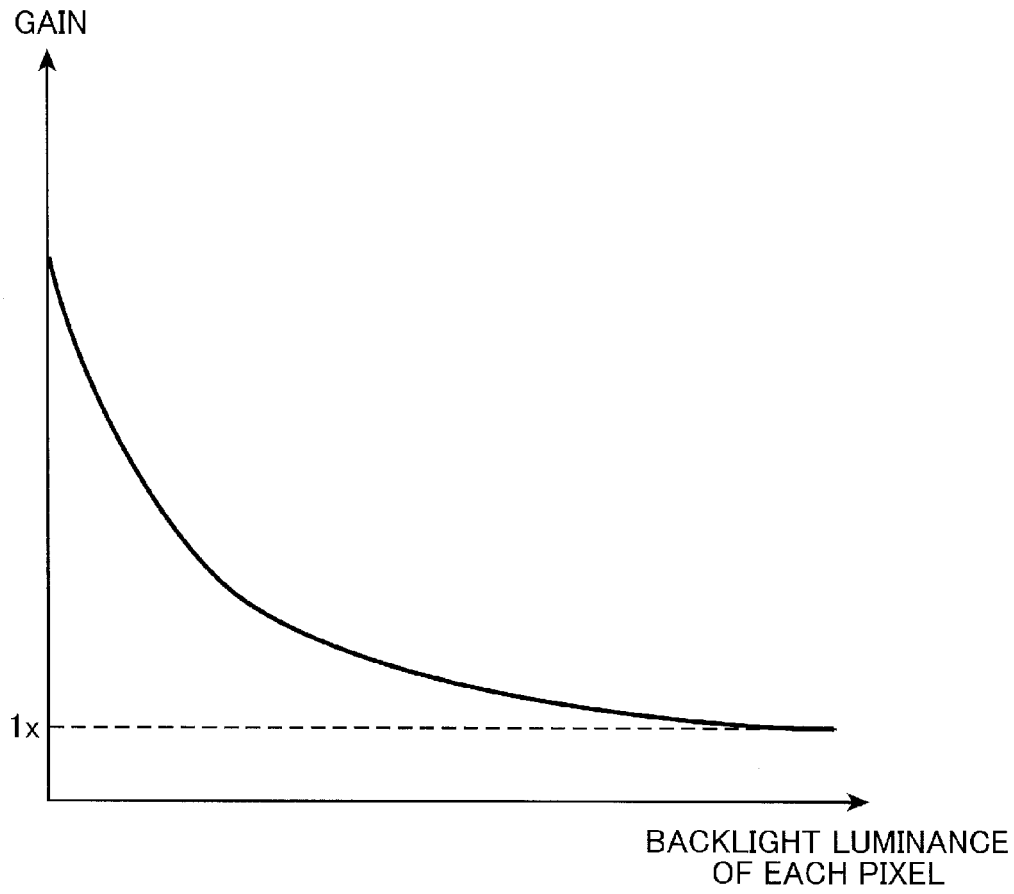
FIG. 6 is a diagram illustrating one example of processing by the signal correction portion.

FIG. 6 shows the relationship between the emission luminance of a light source portion 104 of the backlight unit 102 and the gain value, when a gain is applied to an input image signal, which is one example of the processing performed by the signal correction portion 116. As shown in FIG. 6, when the backlight luminance is high, the gain is set to 1x, whereas when the backlight luminance is low, the gain is set to a larger value. It is possible to adopt various compositions in the signal correction portion 116, such as a composition in which the characteristics shown in FIG. 6 are provided as a look-up table, or a composition in which an approximation calculation is carried out by providing a numerical formula that expresses the characteristics shown in FIG. 6. Moreover, the signal correction method in the signal correction portion 116 is not limited to a composition which applies gain to the input image signal, and for example, it is also possible to correct the input image signal by a method such as changing the gamma curve used to perform gamma correction, for example.

Returning to FIG. 1, the panel driver 118 drives the liquid crystals corresponding to the respective pixels of the liquid crystal display panel 100 in accordance with the transmissivity of the respective pixels which are output from the signal correction portion 116.

As described above, according to this embodiment, the setting portion 112 generates sub-regions according to the division number N which is set in accordance with the luminance distribution of the light source portion 104, by dividing the divided regions, and therefore it is possible to generate sub-regions of a division number corresponding to the luminance distribution of the light source portion 104. Consequently, it is possible to prevent the generation of an excessive number of sub-regions and excessive increase in the amount of calculation involved.

Moreover, according to this embodiment, the setting portion 112 sets the emission luminance of the divided region which contains a sub-region as the emission luminance of that sub-region, and therefore it is possible to set the emission luminance of the sub-regions easily.

Furthermore, according to this embodiment, the linear interpolation portion 114 determines an estimated value of the emission luminance distribution of the backlight unit 102, for each pixel, using the emission luminance of the sub-regions, by means of the linear interpolation, and therefore it is possible to determine an estimated value of the emission luminance distribution of the backlight unit 102 with a simple composition, and at low cost, without performing complicated calculations.

Second Embodiment

Figure 7:
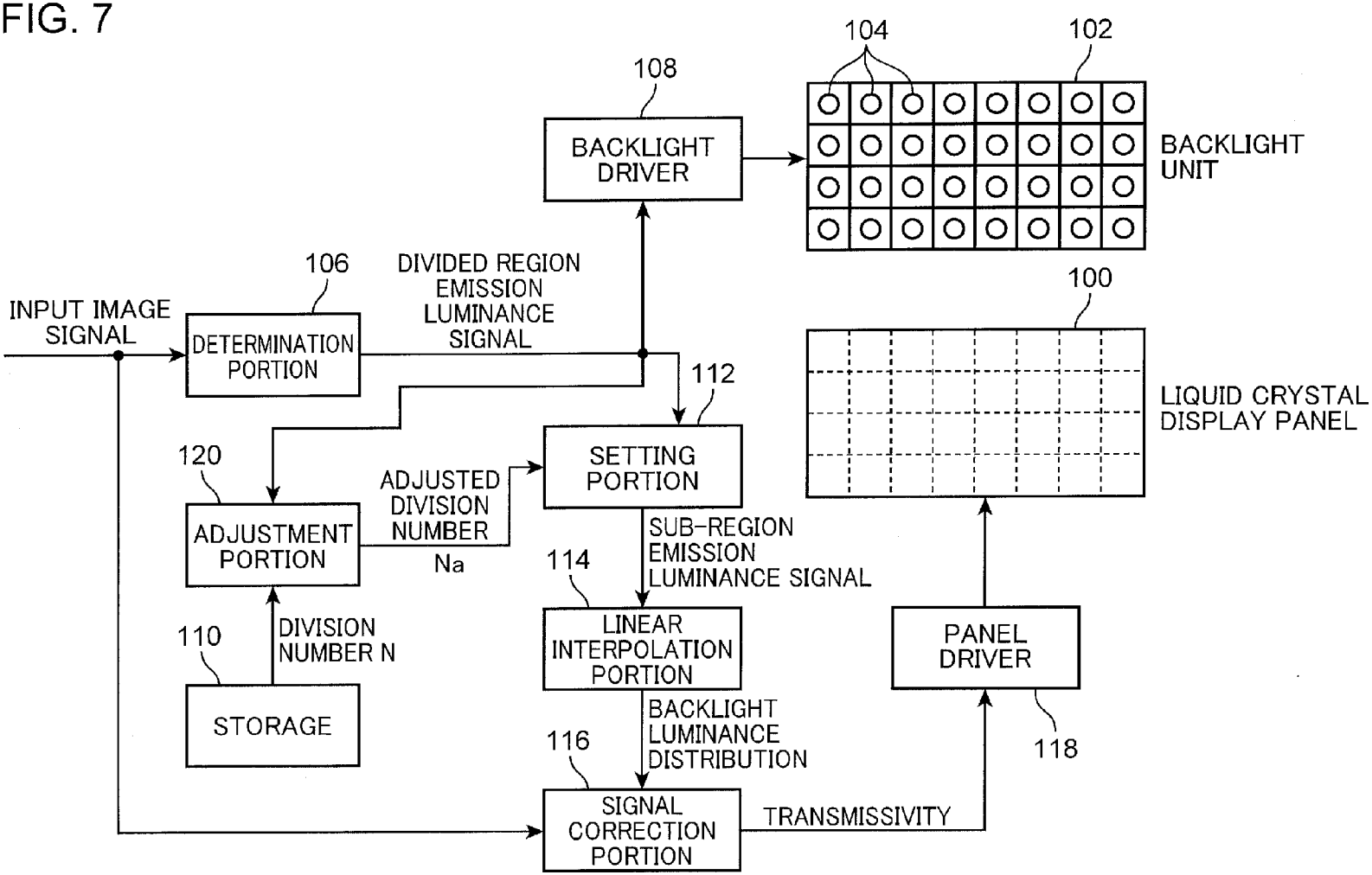
FIG. 7 is a block diagram showing a composition of a liquid crystal display device according to a second embodiment of the present invention.
Figure 8:
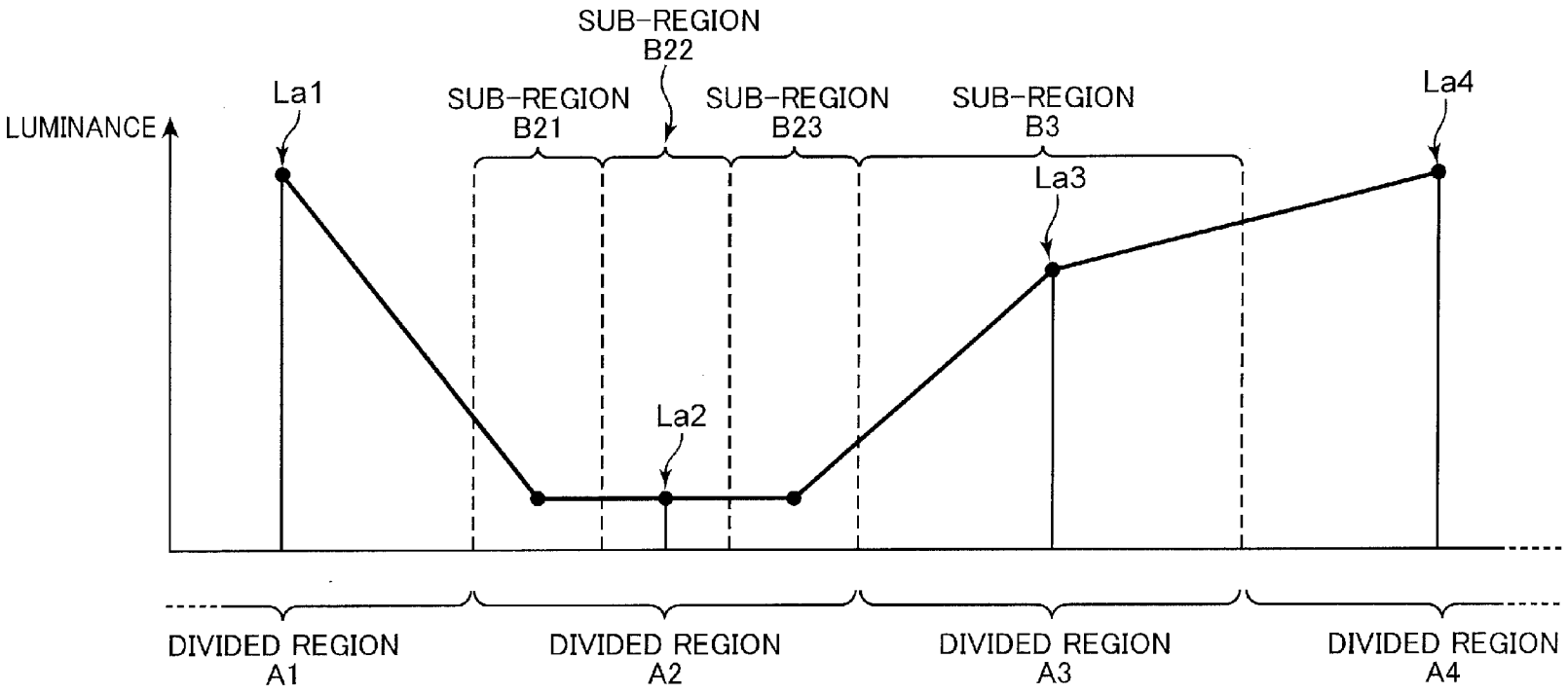
FIG. 8 is a diagram illustrating sub-regions which are generated by dividing the divided regions in the second embodiment.

A liquid crystal display device according to a second embodiment of the present invention will now be described. FIG. 7 is a block diagram showing a composition of a liquid crystal display device according to a second embodiment of the present invention. FIG. 8 is a diagram illustrating sub-regions which are generated by dividing the divided regions in the second embodiment. In the second embodiment, components which are similar to the first embodiment are denoted by similar reference numerals. The liquid crystal display device according to the second embodiment which is shown in FIG. 7 includes an adjustment portion 120 in addition to the constituent elements of the liquid crystal display device according to the first embodiment which is shown in FIG. 1. Below, the second embodiment is described by focussing on the points of difference with respect to the first embodiment.

The adjustment portion 120 judges the size relationship between the emission luminance of the first divided region, and the emission luminance of the second and third divided regions, which are adjacent on either side of the first divided region in the adjacent direction, the three emission luminance being determined by the determination portion 106. The adjustment portion 120 adjusts the division number N stored in the storage 110 in accordance with the judgment result, to generate an adjusted division number Na. The adjustment portion 120 generates the adjusted division number Na (>N) by increasing the division number N of the first divided region, when the emission luminance of the first divided region is greater or smaller than the emission luminance of the adjacently positioned second and third divided regions. The adjustment portion 120 generates the adjusted division number Na=N without increasing the division number N of the first divided region, when the emission luminance of the first divided region is an intermediate value between the emission luminance of the adjacently positioned second and third divided regions. Below, a concrete example of the functions of the adjustment portion 120 is described with reference to FIG. 8.

In this embodiment, as shown in FIG. 8, the size relationship between the emission luminance La1, La2, La3 and La4 of the divided regions A1, A2, A3 and A4 determined by the determination portion 106 is La1>La2<La3<La4. Furthermore, in this embodiment, light sources which produce a gradual change in the luminance distribution at the boundaries between divided regions, as shown in FIG. 2, are used as the light source portions 104. Consequently, in this embodiment, the division number N=N3 stored in the storage 110 is N3=1.

When the divided region A2 is taken to be the first divided region, the adjustment portion 120 judges the size relationship between the emission luminance La2 of the first divided region A2, and the emission luminance La3 of the second divided region A3 which is adjacent to the first divided region A2 in the adjacent direction (the horizontal direction in FIG. 8) and the emission luminance La1 of the third divided region A1 which is adjacent to the first divided region A2 on the opposite side to the second divided region A3 in the adjacent direction. In this embodiment, as shown in FIG. 8, the adjustment portion 120 judges that La1>La2<La3. The emission luminance La2 of the first divided region A2 is smaller than the emission luminance La3 and La1 of the adjacently positioned second and third divided regions A3 and A1, and therefore the adjustment portion 120 generates the adjusted division number Na=N4=3 by increasing the division number N=N3=1. The setting portion 112 divides the first divided region A2 to generate three sub-regions B21 to B23, corresponding to the adjusted division number.

Furthermore, when the divided region A3 is taken to be the first divided region, the adjustment portion 120 judges the size relationship between the emission luminance La3 of the first divided region A3, and the emission luminance La4 of the second divided region A4 which is adjacent to the first divided region A2 in the adjacent direction and the emission luminance La2 of the third divided region A2 which is adjacent to the first divided region A3 on the opposite side to the second divided region A4 in the adjacent direction. In this embodiment, as shown in FIG. 8, the adjustment portion 120 judges that La2<La3<La4. The emission luminance La3 of the first divided region A3 is an intermediate value between the emission luminance La4 and La2 of the adjacently positioned second and third divided regions A4 and A2, and therefore the adjustment portion 120 generates an adjusted division number Na=N5=1 without increasing the division number N=N3=1. The setting portion 112 generates one sub-region B3, corresponding to the adjusted division number, from the first divided region A3.

As described above, according to the second embodiment, the adjustment portion 120 generates an adjusted division number Na (>N) by increasing the division number N stored in the storage 110, in the case where the emission luminance of the first divided region is greater or smaller than the emission luminance of the adjacently positioned second and third divided regions, which are adjacent to the first divided region in the adjacent direction. The setting portion 112 divides the divided region to generate a number of sub-regions corresponding to the adjusted division number. Therefore, it is possible to determine a smoother estimated value of the emission luminance distribution of the backlight unit 102.

In other words, in the case where the emission luminance of the first divided region is greater or smaller than the emission luminance of the adjacently positioned second and third divided regions, and when the division number is N=1, that is, the first divided region is set directly as a sub-region, the estimated value of the emission luminance distribution along the adjacent direction which is determined by the linear interpolation portion 114 changes between increase and decrease in the first divided region, and a turning point occurs. However, according to the second embodiment, since the adjustment portion 120 generates an adjusted division number Na (>N) by increasing the division number N, and the setting portion 112 generates a number of sub-regions equal to the adjusted division number Na, it is possible to prevent the occurrence of a turning point in the first divided region of the estimated value of the emission luminance distribution of the backlight unit 102.

Furthermore, according to the second embodiment, the adjustment portion 120 generates the adjusted division number Na=N without increasing the division number N stored in the storage 110, in the case where the emission luminance of the first divided region is an intermediate value between the emission luminance of the adjacently positioned second and third divided regions, which are adjacent to the first divided region in the adjacent direction. The setting portion 112 divides the divided region to generate a number of sub-regions corresponding to the adjusted division number Na=N. Therefore, it is possible to avoid the occurrence of an excessively step-like shape in the estimated value of the emission luminance distribution, from the second divided region to the third divided region.

FIG. 8 shows an example of divided regions which are adjacent to the first divided region in the horizontal direction, in order to simplify the description. In other words, in FIG. 8, the horizontal direction corresponds to an adjacent direction. However, in the second embodiment, the same approach can be applied to divided regions which are adjacent to the first divided region in the vertical direction. In this case, the vertical direction corresponds to an adjacent direction.

Furthermore, in the second embodiment described above, in the case where the emission luminance of the first divided region is smaller than the emission luminance of the adjacently positioned second and third divided regions, the adjusted division number Na is increased by two from the division number N, but the number of increase in the adjusted division number Na is not limited to this and may be one. Moreover, the number of increase may be fixed to a uniform value, but may also be increased as the difference between the emission luminance of the first divided region and the emission luminance of the adjacently positioned second and third divided regions becomes larger.

Others

In the embodiments described above, it is possible to adopt a composition in which a diffusion sheet is provided between the liquid crystal display panel 100 and the backlight unit 102, and the light emitted from the light source portions 104 of the backlight unit 102 is thereby homogenized. In this modification, the value of the division number N stored in the storage 110 may be set in accordance with the luminance distribution of the diffused light which is emitted from the light source portions 104 and diffused by the diffusion sheet.

In the respective embodiments described above, as shown in FIG. 3C, for example, the setting portion 112 sets the emission luminance of the sub-regions B11 to B14 to a value equal to the emission luminance La1 of the divided region A1, and sets the emission luminance of the sub-regions B21 to B24 to a value equal to the emission luminance La2 of the divided region A2. However, the present invention is not limited to this.

Figure 9:
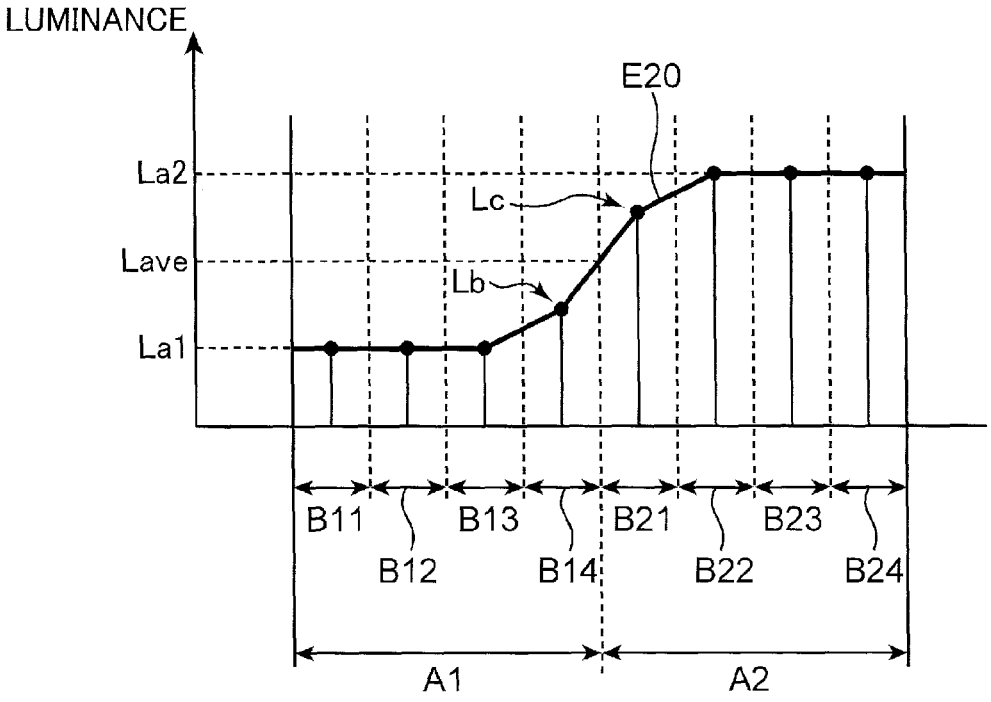
FIG. 9 is a diagram showing a different example of the estimated values of the emission luminance distribution.

FIG. 9 is a diagram showing a different example of the estimated values of the emission luminance distribution. In the embodiment shown in FIG. 9, the setting portion 112 sets the emission luminance of the sub-regions B11 to B14 to a value equal to the emission luminance La1 of the divided region A1, sets the emission luminance of the sub-regions B21 to B24 to a value equal to the emission luminance La2 of the divided region A2, and then changes the setting of the emission luminance of the sub-regions B14 and B21 which are adjacent to the boundaries with the divided regions A1 and A2.

In other words, the setting portion 112 changes the setting of the emission luminance of the sub-region B14 from a value equal to the emission luminance La1 of the divided region A1 to emission luminance Lb which is a value between the average value Lave of the emission luminance La1 and La2 of the divided regions A1 and A2, and the emission luminance La1 of the divided region A1. Furthermore, the setting portion 112 changes the setting of the emission luminance of the sub-region B21 from a value equal to the emission luminance La2 of the divided region A2 to emission luminance Lc which is a value between the average value Lave of the emission luminance La1 and La2 of the divided regions A1 and A2, and the emission luminance La2 of the divided region A2. Through these changed settings, the emission luminance Lb and Lc of the sub-regions B14 and B21 which are adjacent to the boundaries of the divided regions A1 and A2 respectively have the relationships: La1<Lb<Lave, Lave<Lc<La2.

The setting portion 112 is able to change the settings as described above, by providing a low-pass filter function, for example. The linear interpolation portion 114 carries out linear interpolation using the emission luminance Lb and Lc of the sub-regions B14 and B21 of which the settings have been changed, to calculate an estimated value E20 of the emission luminance distribution of the backlight unit 102, as shown in FIG. 9.

According to the modification shown in FIG. 9, the rate of change in the emission luminance at the boundaries of the divided regions A1 and A2 is relatively gradual compared to the case shown in FIG. 3C. Therefore, it is possible to determine a smoother estimated value E20 of the emission luminance distribution of the backlight unit 102. As a result of this, it is possible to approximate the actual emission luminance distribution more closely. Furthermore, since the occurrence of a sudden turning point in the estimated value of the emission luminance distribution can be suppressed, it is possible to eliminate the risk of a turning point occurring in the correction result of the input image signal performed by the signal correction portion 116.

In the respective embodiments described above, a case is described in which the backlight unit 102 adopts a direct light system, but the present invention is not limited to this and may also adopt an edge light system. For example, as a backlight unit of an edge light system, it is possible to adopt a composition in which LEDs are arranged along an edge face of one end side of a liquid crystal display panel and LEDs are arranged along an edge face of the other end side which is opposite to the one end side. In the case of a liquid crystal display device which is provided with a backlight unit based on an edge light system of this kind, it is possible to adopt an embodiment in which sub-regions are generated by dividing the divided regions in only the arrangement direction of the LED.

The concrete embodiments described above mainly include an invention having the following composition.

A display device according to an aspect of the present invention includes: a display panel which has pixels, is virtually divided into divided regions including a first divided region and a second divided region that are mutually adjacent in a predetermined adjacent direction, and displays an image corresponding to an input image signal; a backlight portion which has light source portions that are respectively arranged corresponding to the divided regions and emit light with a predetermined luminance distribution to illuminate the display panel from a rear surface thereof; a determination portion which determines emission luminance for each of the divided regions, in response to the image signal; a backlight driver which drives the light source portions so as to emit light at the emission luminance determined for each of the divided regions by the determination portion; a storage which stores a division number that is set in advance on the basis of the luminance distribution of the light source portions; a setting portion which divides the divided regions to respectively generate sub-regions of a number equal to the division number, and sets the emission luminance of the generated sub-regions to a value equal to the emission luminance of the divided region which contains the sub-regions; a linear interpolation portion which performs linear interpolation in pixel units using emission luminance of a first sub-region and emission luminance of a second sub-region, to calculate, for each of the pixels, an estimated value of the emission luminance distribution of the backlight portion in a region from the first sub-region to the second sub-region, the first sub-region being a sub-region, of the first divided region, which is adjacent to a boundary between the first divided region and the second divided region, the second sub-region being a sub-region, of the second divided region, which is adjacent to the first sub-region; a signal correction portion which corrects the image signal, for each of the pixels, on the basis of the estimated value calculated by the linear interpolation portion, to generate drive signals for the pixels of the display panel; and a panel driver which drives the pixels of the display panel in response to the drive signals generated by the signal correction portion.

According to this composition, the display panel has pixels, is divided virtually into divided regions including a first divided region and a second divided region that are mutually adjacent in a predetermined adjacent direction, and displays an image corresponding to an input image signal. The backlight portion has light source portions which are arranged respectively corresponding to the divided regions and emit light with a predetermined luminance distribution to illuminate the display panel from a rear surface of the display panel. The determination portion determines the emission luminance for each of the divided regions in response to the image signal. The backlight driver drives the light source portions so as to emit light at the emission luminance determined for each of the divided regions by the determination portion. The storage stores a division number that is set in advance on the basis of the luminance distribution of the light source portions. The setting portion divides the divided regions to respectively generate sub-regions of a number equal to the division number, and sets the emission luminance of the generated sub-regions to a value equal to the emission luminance of the divided region which contains the sub-regions. The linear interpolation portion performs linear interpolation in pixel units using emission luminance of a first sub-region and emission luminance of a second sub-region, to calculate, for each of the pixels, an estimated value of the emission luminance distribution of the backlight portion in a region from the first sub-region to the second sub-region, the first sub-region being a sub-region of the first divided region which is adjacent to a boundary between the first divided region and the second divided region, the second sub-region being a sub-region of the second divided region which is adjacent to the first sub-region. The signal correction portion corrects the image signal for each pixel on the basis of the estimated value calculated by the linear interpolation portion to generate drive signals for the pixels of the display panel. The panel driver drives the pixels of the display panel in response to the drive signals generated by the signal correction portion.

Therefore, since the setting portion divides the divided regions to generate sub-regions equal in number to the division number which is set in advance on the basis of the luminance distribution of the light source portions, it is possible to generate sub-regions of the division number that is suited to the luminance distribution of the light source portions. Furthermore, since the setting portion sets the emission luminance of the generated sub-regions to a value equal to the emission luminance of the divided region, it is possible to set the emission luminance of the sub-regions by a simple composition, without requiring complicated calculations. Furthermore, since the linear interpolation portion performs linear interpolation in pixel units, using the emission luminance of the first sub-region and the emission luminance of the second sub-region, to calculate an estimated value of the emission luminance distribution of the backlight portion, for each pixel, in a region from the first sub-region to the second sub-region, it is possible to calculate the estimated value of the emission luminance distribution of the backlight portion by a simple composition and at low cost. Moreover, since the sub-regions are generated in a number equal to the division number which is suited to the luminance distribution of the light source portions, it is possible to calculate the estimated value of the emission luminance distribution of the backlight portion, accurately, in accordance with the luminance distribution of the light source portions. Since the signal correction portion corrects the image signal, for each pixel, on the basis of the estimated value which has been calculated with high accuracy to generate drive signals for the pixels of the display panel, and the panel driver drives the pixels of the display panel on the basis of the generated drive signals, it is possible to display images of high quality on the display panel.

The display device described above, desirably, further includes an adjustment portion which adjusts the division number to generate an adjusted division number, wherein the divided regions further includes a third divided region which is adjacent to the first divided region on an opposite side to the second divided region in the adjacent direction, the adjustment portion generates the adjusted division number in accordance with a size relationship between the emission luminance of the first divided region determined by the determination portion, and the emission luminance of the second and third divided regions determined by the determination portion, and the setting portion divides the first divided region to generate the sub-regions of a number equal to the adjusted division number, and sets the emission luminance of the generated sub-regions to a value equal to the emission luminance of the first divided region.

According to this composition, the divided regions further include a third divided region which is adjacent to the first divided region on the opposite side to the second divided region in the adjacent direction. The adjustment portion adjusts the division number to generate an adjusted division number in accordance with a size relationship between the emission luminance of the first divided region determined by the determination portion, and the emission luminance of the second and third divided regions determined by the determination portion. The setting portion divides the first divided region to generate the sub-regions of a number equal to the adjusted division number, and sets the emission luminance of the generated sub-regions to a value equal to the emission luminance of the first divided region. Therefore, it is possible to divide the first divided region to generate sub-regions of a number equal to the adjusted division number that is suited to the size relationship between the emission luminance of the first divided region and the emission luminance of the second and third divided regions. Consequently, it is possible to calculate the estimated value of the emission luminance distribution of the backlight portion, more preferably.

In the display device described above, desirably, the adjustment portion generates the adjusted division number by increasing the division number, in the case where the emission luminance of the first divided region is lower or higher than the emission luminance of both the second and third divided regions, and generates the adjusted division number having a same value as the division number, in the case where the emission luminance of the first divided region is an intermediate value between the emission luminance of the second and third divided regions.

In the case where the emission luminance of the first divided region is lower or higher than the emission luminance of both the second and third divided regions, the change of the emission luminance in the adjacent direction from the second divided region, through the first divided region, to the third divided region, has a downwardly or upwardly protruding shape in the first divided region. In response to this, according to this composition, the adjustment portion generates the adjusted division number by increasing the division number, and therefore it is possible to avoid the occurrence of a sharp turning point in the estimated value of the emission luminance distribution of the backlight portion, in the first divided region. Consequently, a beneficial effect is obtained in that there is no adverse effect of sharp turning points on the image displayed on the display panel. On the other hand, since an adjusted division number having the same value as the division number is generated in the case where the emission luminance of the first divided region is an intermediate value between the emission luminance of the second and third divided regions, it is possible to avoid the occurrence of an excessively step-like shape in the estimated value of the emission luminance distribution, from the second divided region to the third divided region.

In the display device described above, desirably, the setting portion sets the emission luminance of the sub-region as the emission luminance of a center position of the sub-region, and when the emission luminance of the first divided region is defined as a first luminance value, the emission luminance of the second divided region is defined as a second luminance value, and a pixel positioned on a straight line connecting the center position of the first sub-region and the center position of the second sub-region is defined as a calculation target pixel, the linear interpolation portion sets the emission luminance of a pixel in the center position of the first sub-region to the first luminance value, sets the emission luminance of a pixel in the center position of the second sub-region to the second luminance value, and sets the emission luminance of the calculation target pixel to a value obtained by weighting the first luminance value with a coefficient based on a distance from the calculation target pixel to the center position of the first sub-region, weighting the second luminance value with a coefficient based on a distance from the calculation target pixel to the center position of the second sub-region, and adding the weighted first luminance value and the weighted second luminance value.

According to this composition, the setting portion sets the emission luminance of the sub-region as the emission luminance of a center position of the sub-region. The linear interpolation portion sets the emission luminance of a pixel in the center position of the first sub-region to the first luminance value, sets the emission luminance of a pixel in the center position of the second sub-region to the second luminance value, and sets the emission luminance of the calculation target pixel to a value obtained by weighting and adding the first luminance value and the second luminance value using coefficients based on distances from the calculation target pixel to the center position of the first sub-region and the center position of the second sub-region. Consequently, it is possible to accurately calculate the emission luminance of the calculation target pixel which is positioned on a straight line connecting the center position of the first sub-region and the center position of the second sub-region.

Furthermore, desirably, in the display device described above, the divided regions each have a square shape, are provided in a matrix configuration, and further include a fourth divided region which is adjacent to the first divided region in a perpendicular direction that is perpendicular to the adjacent direction, and a fifth divided region which is adjacent to the fourth divided region in the adjacent direction and is adjacent to the second divided region in the perpendicular direction, the setting portion divides the divided regions to respectively generate the sub-regions having a square shape, and sets the emission luminance of each sub-region as the emission luminance of a center position of the sub-region, the emission luminance of the first, second, fourth and fifth divided regions are respectively defined as first, second, fourth and fifth luminance values, the sub-regions of the fourth and fifth divided regions which include a common vertex of the first, second, fourth and fifth divided regions are respectively defined as fourth and fifth sub-regions, the first and second sub-regions are defined as sub-regions which include a common vertex of the first, second, fourth and fifth divided regions, a pixel positioned within a square area enclosed by the centers of the first, second, fourth and fifth sub-regions is defined as a calculation target pixel, distances in the adjacent direction from the calculation target pixel to the center positions of the first and second sub-regions are defined as first and second distances, distances in the perpendicular direction from the calculation target pixel to the center positions of the first and fourth sub-regions are defined as third and fourth distances, and the linear interpolation portion sets the emission luminance of the pixels in the center positions of the first, second, fourth and fifth sub-regions respectively to the first, second, fourth and fifth luminance values, calculates a value, which is obtained by weighting the first luminance value with a coefficient based on the first distance, weighting the second luminance value with a coefficient based on the second distance, and adding the weighted first luminance value and the weighted second luminance value, as a first interpolation value, calculates a value, which is obtained by weighting the fourth luminance value with a coefficient based on the first distance, weighting the fifth luminance value with a coefficient based on the second distance, adding the weighted fourth luminance value and the weighted fifth luminance value, as a second interpolation value, and sets a value, which is obtained by weighting the first interpolation value with a coefficient based on the third distance, weighting the second interpolation value with a coefficient based on the fourth distance, and adding the weighted first interpolation value and the weighted second interpolation value, as an estimated value of the emission luminance of the calculation target pixel.

According to this composition, the divided regions each have a square shape and are provided in a matrix configuration. Furthermore, the divided regions further include a fourth divided region which is adjacent to the first divided region in a perpendicular direction that is perpendicular to the adjacent direction, and a fifth divided region which is adjacent to the fourth divided region in the adjacent direction and is adjacent to the second divided region in the perpendicular direction. The setting portion divides the divided regions to respectively generate sub-regions having a square shape, and sets the emission luminance of each sub-region as the emission luminance of a center position of the sub-region. The linear interpolation portion respectively sets the emission luminance of the pixels in the center positions of the first, second, fourth and fifth sub-regions to the first, second, fourth and fifth luminance values. Furthermore, the linear interpolation portion calculates a value obtained by weighting and adding the first luminance value and the second luminance value using respective coefficients based on the first distance and the second distance, as a first interpolation value. Moreover, the linear interpolation portion calculates a value obtained by weighting and adding the fourth luminance value and the fifth luminance value using respective coefficients based on the first distance and the second distance, as a second interpolation value. Moreover, the linear interpolation portion sets a value obtained by weighting and adding the first interpolation value and the second interpolation value using respective coefficients based on the third distance and the fourth distance, as an estimated value of the emission luminance of the calculation target pixel. Consequently, it is possible to calculate an estimated value of the emission luminance distribution of the backlight portion, accurately, by a simple composition. In the composition described above, when the adjacent direction is the horizontal direction, for example, the perpendicular direction is the vertical direction, and when the adjacent direction is the vertical direction, for example, the perpendicular direction is the horizontal direction.

Furthermore, desirably, in the display device described above, the setting portion changes the setting of the emission luminance of the first sub-region from a value equal to the emission luminance of the first divided region to a first intermediate value between an average value of the emission luminance of the first and second divided regions, and the emission luminance of the first divided region, and changes the setting of the emission luminance of the second sub-region from a value equal to the emission luminance of the second divided region to a second intermediate value between the average value and the emission luminance of the second divided region.

According to this composition, the setting portion changes the setting of the emission luminance of the first sub-region from a value equal to the emission luminance of the first divided region to a first intermediate value between an average value of the emission luminance of the first and second divided regions, and the emission luminance of the first divided region. Furthermore, the setting portion changes the setting of the emission luminance of the second sub-region from a value equal to the emission luminance of the second divided region to a second intermediate value between the average value and the emission luminance of the second divided region.

Therefore, since the settings of emission luminance of the first sub-region and the second sub-region are changed to first and second intermediate values, when linear interpolation is performed by the linear interpolation portion, it is possible to obtain smoother estimated values of the emission luminance distribution in the vicinity of the boundary between the first and second divided regions, compared to a case where these settings are not changed. Consequently, it is possible to avoid the occurrence of a turning point in the estimated value of the emission luminance distribution, and to prevent from declining in the quality of the image displayed on the display panel due to the occurrence of a turning point.

Moreover, a display method according to an aspect of the present invention is a display method used in a display device having: a display panel which has pixels, is virtually divided into divided regions including a first divided region and a second divided region that are mutually adjacent in a predetermined adjacent direction, and displays an image corresponding to an input image signal; and a backlight portion which has light source portions that are respectively arranged corresponding to the divided regions and emit light with a predetermined luminance distribution to illuminate the display panel from a rear surface thereof, the display method including: a determining step of determining emission luminance for each of the divided regions, in response to the image signal; a backlight driving step of driving the light source portions so as to emit light at the emission luminance determined for each of the divided regions in the determining step; a setting step of respectively dividing the divided regions to generate sub-regions of a number equal to a division number predetermined on the basis of the luminance distribution of the light source portions, and setting the emission luminance of the generated sub-regions to a value equal to the emission luminance of the divided region which contains the sub-regions; a linear interpolating step of performing linear interpolation in pixel units using emission luminance of a first sub-region and emission luminance of a second sub-region to calculate, for each of the pixels, an estimated value of the emission luminance distribution of the backlight portion in a region from the first sub-region to the second sub-region, the first sub-region being a sub-region, of the first divided region, which is adjacent to a boundary between the first divided region and the second divided region, the second sub-region being a sub-region, of the second divided region, which is adjacent to the first sub-region; a signal correcting step of correcting the image signal, for each of the pixels, on the basis of the estimated value calculated in the linear interpolating step to generate drive signals for the pixels of the display panel; and a panel driving step of driving the pixels of the display panel in response to the drive signals generated in the signal correcting step.

According to this composition, the determining step determines the emission luminance for each of the divided regions, in response to the image signal. The backlight driving step drives the light source portions so as to emit light at the emission luminance determined for each of the divided regions in the determining step. The setting step divides the divided regions to respectively generate sub-regions of a number equal to a division number predetermined on the basis of the luminance distribution of the light source portions, and sets the emission luminance of the generated sub-regions to a value equal to the emission luminance of the divided region which contains the sub-regions. The linear interpolating step performs linear interpolation in pixel units using emission luminance of a first sub-region and emission luminance of a second sub-region to calculate, for each of the pixels, an estimated value of the emission luminance distribution of the backlight portion in a region from the first sub-region to the second sub-region, the first sub-region being a sub-region, of the first divided region, which is adjacent to a boundary between the first divided region and the second divided region, the second sub-region being a sub-region, of the second divided region, which is adjacent to the first sub-region. The signal correcting step corrects the image signal, for each of the pixels, on the basis of the estimated value calculated in the linear interpolating step to generate drive signals for the pixels of the display panel. The panel driving step drives the pixels of the display panel in response to the drive signals generated in the signal correcting step.

Therefore, since the setting step divides the divided regions to generate sub-regions equal in number to the division number which is set in advance on the basis of the luminance distribution of the light source portions, it is possible to generate sub-regions of the division number that is suited to the luminance distribution of the light source portions. Furthermore, since the setting step sets the emission luminance of the generated sub-regions to a value equal to the emission luminance of the divided region, it is possible to set the emission luminance of the sub-regions by a simple composition, without requiring complicated calculations. Furthermore, since the linear interpolating step performs linear interpolation in pixel units, using the emission luminance of the first sub-region and the emission luminance of the second sub-region, to calculate an estimated value of the emission luminance distribution of the backlight portion, for each pixel, in a region from the first sub-region to the second sub-region, it is possible to calculate the estimated value of the emission luminance distribution of the backlight portion by a simple composition and at low cost. Moreover, since the sub-regions are generated in a number equal to the division number which is suited to the luminance distribution of the light source portions, it is possible to calculate the estimated value of the emission luminance distribution of the backlight portion, accurately, in accordance with the luminance distribution of the light source portions. Since the signal correcting step corrects the image signal, for each pixel, on the basis of the estimated value which has been calculated with high accuracy to generate drive signals for the pixels of the display panel, and the panel driving step drives the pixels of the display panel on the basis of the generated drive signals, it is possible to display images of high quality on the display panel.

According to the present invention, since the divided regions are divided to generate sub-regions equal in number to the division number which is set in advance on the basis of the luminance distribution of the light source portions, it is possible to generate sub-regions of the division number that is suited to the luminance distribution of the light source portions. Furthermore, since the emission luminance of the generated sub-regions are set to a value equal to the emission luminance of the divided region, it is possible to set the emission luminance of the sub-regions by a simple composition, without requiring complicated calculations. Moreover, since linear interpolation is performed in pixel units and an estimated value of the emission luminance distribution of the backlight portion in the region from the first sub-region to the second sub-region is calculated for each pixel, it is possible to calculate the estimated value of the emission luminance distribution of the backlight portion by a simple composition and at low cost. Furthermore, since the sub-regions are generated in a number equal to the division number which is suited to the luminance distribution of the light source portions, it is possible to calculate the estimated value of the emission luminance distribution of the backlight portion, accurately, in accordance with the luminance distribution of the light source portions. As a result of this, it is possible to display an image of high quality on the display panel.

The present invention is useful as a display device and a display method capable of displaying images of high quality, in a display device including a display panel which displays an image corresponding to an input image signal and light sources which illuminate the display panel from a rear surface.

The invention claimed is:

1. A display device, comprising:

a display panel which has pixels is virtually divided into divided regions including a first divided region and a second divided region that are mutually adjacent in a predetermined adjacent direction, and displays an image corresponding to an input image signal;

a backlight portion which has light source portions that are respectively arranged corresponding to the divided regions and emit light with a predetermined luminance distribution to illuminate the display panel from a rear surface thereof;

a determination portion which determines emission luminance for each of the divided regions, in response to the image signal;

a backlight driver which drives the light source portions so as to emit light at the emission luminance determined for each of the divided regions by the determination portion;

a storage which stores a division number N where N is a positive integer, the division number N being set in advance on the basis of the luminance distribution of the light source portions;

a dividing portion which divides the divided regions to respectively generate sub-regions of a number equal to the division number N;

a setting portion which sets the emission luminance of the generated sub-regions to a value equal to the emission luminance of the divided region which contains the sub-regions;

a linear interpolation portion which performs linear interpolation in pixel units using emission luminance of a first sub-region and emission luminance of a second sub-region, to calculate, for each of the pixels, an estimated value of the emission luminance distribution of the backlight portion in a region from the first sub-region to the second sub-region, the first sub-region being a sub-region, of the first divided region, which is adjacent to a boundary between the first divided region and the second divided region, the second sub-region being a sub-region, of the second divided region, which is adjacent to the first sub-region;

a signal correction portion which corrects the image signal, for each of the pixels, on the basis of the estimated value calculated by the linear interpolation portion, to generate drive signals for the pixels of the display panel;

an adjustment portion which adjusts the division number to generate an adjusted division number; and a panel driver which drives the pixels of the display panel in response to the drive signals generated by the signal correction portion, wherein the light source portions emit light with the predetermined luminance distribution identical to each other, the divided regions further includes a third divided region which is adjacent to the first divided region on an opposite side to the second divided region in the adjacent direction, the adjustment portion generates the adjusted division number in accordance with a size relationship between the emission luminance of the first divided region determined by the determination portion, and the emission luminance of the second and third divided regions determined by the determination portion, the dividing portion divides the first divided region to generate the sub-regions of a number equal to the adjusted division number, and the setting portion sets the emission luminance of the generated sub-regions to a value equal to the emission luminance of the first divided region.

2. The display device according to claim 1, wherein the adjustment portion generates the adjusted division number by increasing the division number, in the case where the emission luminance of the first divided region is lower or higher than the emission luminance of both the second and third divided regions, and generates the adjusted division number having a same value as the division number, in the case where the emission luminance of the first divided region is an intermediate value between the emission luminance of the second and third divided regions.

3. The display device according to claim 1, wherein the setting portion sets the emission luminance of the sub-region as the emission luminance of a center position of the sub-region, and when the emission luminance of the first divided region is defined as a first luminance value, the emission luminance of the second divided region is defined as a second luminance value, and a pixel positioned on a straight line connecting the center position of the first sub-region and the center position of the second sub-region is defined as a calculation target pixel, the linear interpolation portion sets the emission luminance of a pixel in the center position of the first sub-region to the first luminance value, sets the emission luminance of a pixel in the center position of the second sub-region to the second luminance value, and sets the emission luminance of the calculation target pixel to a value obtained by weighting the first luminance value with a coefficient based on a distance from the calculation target pixel to the center position of the first sub-region, weighting the second luminance value with a coefficient based on a distance from the calculation target pixel to the center position of the second sub-region, and adding the weighted first luminance value and the weighted second luminance value.

4. The display device according to claim 1, wherein the divided regions each have a square shape, are provided in a matrix configuration, and further include a fourth divided region which is adjacent to the first divided region in a perpendicular direction that is perpendicular to the adjacent direction, and a fifth divided region which is adjacent to the fourth divided region in the adjacent direction and is adjacent to the second divided region in the perpendicular direction, the setting portion divides the divided regions to respectively generate the sub-regions having a square shape, and sets the emission luminance of each sub-region as the emission luminance of a center position of the sub-region, the emission luminance of the first, second, fourth and fifth divided regions are respectively defined as first, second, fourth and fifth luminance values, the sub-regions of the fourth and fifth divided regions which include a common vertex of the first, second, fourth and fifth divided regions are respectively defined as fourth and fifth sub-regions, the first and second sub-regions are defined as sub-regions which include a common vertex of the first, second, fourth and fifth divided regions, a pixel positioned within a square area enclosed by the centers of the first, second, fourth and fifth sub-regions is defined as a calculation target pixel, distances in the adjacent direction from the calculation target pixel to the center positions of the first and second sub-regions are defined as first and second distances, distances in the perpendicular direction from the calculation target pixel to the center positions of the first and fourth sub-regions are defined as third and fourth distances, and the linear interpolation portion sets the emission luminance of the pixels in the center positions of the first, second, fourth and fifth sub-regions respectively to the first, second, fourth and fifth luminance values, calculates a value, which is obtained by weighting the first luminance value with a coefficient based on the first distance, weighting the second luminance value with a coefficient based on the second distance, and adding the weighted first luminance value and the weighted second luminance value, as a first interpolation value, calculates a value, which is obtained by weighting the fourth luminance value with a coefficient based on the first distance, weighting the fifth luminance value with a coefficient based on the second distance, adding the weighted fourth luminance value and the weighted fifth luminance value, as a second interpolation value, and sets a value, which is obtained by weighting the first interpolation value with a coefficient based on the third distance, weighting the second interpolation value with a coefficient based on the fourth distance, and adding the weighted first interpolation value and the weighted second interpolation value, as an estimated value of the emission luminance of the calculation target pixel.

5. The display device according to claim 1, wherein the setting portion changes the setting of the emission luminance of the first sub-region from a value equal to the emission luminance of the first divided region to a first intermediate value between an average value of the emission luminance of the first and second divided regions, and the emission luminance of the first divided region, and changes the setting of the emission luminance of the second sub-region from a value equal to the emission luminance of the second divided region to a second intermediate value between the average value and the emission luminance of the second divided region.

6. A display method used in a display device including: a display panel which has pixels and is virtually divided into divided regions including a first divided region and a second divided region that are mutually adjacent in a predetermined adjacent direction, and displays an image corresponding to an input image signal; and a backlight portion which has light source portions that are respectively arranged corresponding to the divided regions and emit light with a predetermined luminance distribution to illuminate the display panel from a rear surface thereof, the display method comprising:

a determining step of determining emission luminance for each of the divided regions, in response to the image signal;

a backlight driving step of driving the light source portions so as to emit light at the emission luminance determined for each of the divided regions in the determining step;

a dividing step of respectively dividing the divided regions to generate sub-regions of a number equal to a division number N where N is a positive integer, the division number N being predetermined on the basis of the luminance distribution of the light source portions;

a setting step of setting the emission luminance of the generated sub-regions to a value equal to the emission luminance of the divided region which contains the sub-regions;

a linear interpolating step of performing linear interpolation in pixel units using emission luminance of a first sub-region and emission luminance of a second sub-region to calculate, for each of the pixels, an estimated value of the emission luminance distribution of the backlight portion in a region from the first sub-region to the second sub-region, the first sub-region being a sub-region, of the first divided region, which is adjacent to a boundary between the first divided region and the second divided region, the second sub-region being a sub-region, of the second divided region, which is adjacent to the first sub-region;

a signal correcting step of correcting the image signal, for each of the pixels, on the basis of the estimated value calculated in the linear interpolating step to generate drive signals for the pixels of the display panel;

an adjusting step of adjusting the division number to generate an adjusted division number; and a panel driving step of driving the pixels of the display panel in response to the drive signals generated in the signal correcting step, wherein the light source portions emit light with the predetermined luminance distribution identical to each other, the divided regions further includes a third divided region which is adjacent to the first divided region on an opposite side to the second divided region in the adjacent direction, the adjusting step generates the adjusted division number in accordance with a size relationship between the emission luminance of the first divided region determined by the determining step, and the emission luminance of the second and third divided regions determined by the determining step, the dividing step divides the first divided region to generate the sub-regions of a number equal to the adjusted division number, and the setting step sets the emission luminance of the generated sub-regions to a value equal to the emission luminance of the first divided region.

* * * * *